US009966019B2

(12) United States Patent
Chen et al.

(10) Patent No.: US 9,966,019 B2
(45) Date of Patent: May 8, 2018

(54) LIQUID CRYSTAL DISPLAY WITH ONE THIRD DRIVING STRUCTURE OF PIXEL ARRAY OF DISPLAY PANEL

(71) Applicant: Au Optronics Corporation, Hsinchu (TW)

(72) Inventors: Ken-Ming Chen, Taichung (TW); Chi-Mao Hung, Chiayi (TW); Yao-Jen Hsieh, Hsinchu County (TW); Chao-Liang Lu, Taoyuan (TW); Jing-Tin Kuo, Taipei (TW); Pei-Lin Tien, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 0 days. days.

(21) Appl. No.: 15/158,598

(22) Filed: May 19, 2016

(65) Prior Publication Data

US 2016/0267858 A1 Sep. 15, 2016

Related U.S. Application Data

(62) Division of application No. 12/554,921, filed on Sep. 6, 2009, now Pat. No. 9,373,294.

(30) Foreign Application Priority Data

Jul. 20, 2009 (TW) ..... 98124436 A

(51) Int. Cl.
*G09G 3/36* (2006.01)

(52) U.S. Cl.
CPC ..... *G09G 3/36* (2013.01); *G09G 3/3648* (2013.01); *G09G 2300/0426* (2013.01); *G09G 2310/02* (2013.01); *G09G 2310/0297* (2013.01); *G09G 2310/06* (2013.01); *G09G 2310/08* (2013.01); *G09G 2320/0219* (2013.01)

(58) Field of Classification Search
CPC ..... G09G 3/3648; G09G 3/36; G09G 2300/0426; G09G 2310/02; G09G 2320/0219; G09G 2310/06; G09G 2310/08; G09G 2310/0297
USPC ..... 345/214, 87, 100
See application file for complete search history.

(56) References Cited

U.S. PATENT DOCUMENTS

2003/0112210 A1* 6/2003 Ito ..... G09G 3/3622 345/87
2005/0281127 A1* 12/2005 Okuno ..... G09G 3/3685 365/233.15
2007/0045556 A1* 3/2007 Watanabe ..... H01L 27/14609 250/370.14
2008/0198283 A1* 8/2008 Yoon ..... G09G 3/3648 349/37
2013/0100111 A1* 4/2013 Shirai ..... G09G 3/2011 345/212

* cited by examiner

*Primary Examiner* — Kwang-Su Yang
(74) *Attorney, Agent, or Firm* — JCIPRNET

(57) ABSTRACT

A liquid crystal display (LCD) including a display panel and a source driver is provided. The display panel includes a plurality of pixels arranged in an array. The source driver is coupled to the display panel and includes a plurality of source lines. Each of the source lines of the source driver is responsible for performing the pixel-writing to six corresponding pixel columns in the display panel.

12 Claims, 8 Drawing Sheets

LIQUID CRYSTAL DISPLAY WITH ONE THIRD DRIVING STRUCTURE OF PIXEL ARRAY OF DISPLAY PANEL

CROSS-REFERENCE TO RELATED APPLICATION

This application is a divisional application of and claims the priority benefit of U.S. application Ser. No. 12/554,921, filed on Sep. 6, 2009, now allowed. The previous U.S. application Ser. No. 12/554,921 claims the priority benefit of Taiwan application serial no. 98124436, filed on Jul. 20, 2009. The entirety of each of the above-mentioned patent applications is hereby incorporated by reference herein and made a part of specification.

BACKGROUND OF THE INVENTION

Field of the Invention

The present invention relates to a flat panel display, more particularly, to a liquid crystal display (LCD).

Description of the Related Art

In the presence of all structures of the pixel array of the current LCD panel, one specie is so-called the half source driving (hereinafter "HSD") structure. The HSD structure would reduce the quantity used of source drivers to half by reducing the number of the source lines to half, such that the fabricating cost of the display panel module can be substantially reduced.

FIG. 1 is a diagram of a part of the conventional LCD panel 100 adopting HSD structure; and FIG. 2 is a diagram of a part of driving waveform for the LCD panel 100 as shown in FIG. 1. Referring to FIGS. 1 and 2, FIG. 1 shows that a plurality of red (R), green (G) and blue (B) pixels in the LCD panel 100 which are arranged in an array, gate lines G0~G4 driven by the gate driver (not shown), and source lines D0~D4 driven by the source driver (not shown).

In addition, it can be clearly seen that, in FIG. 2, during the period T1, the scan signals S0 and S1 output from the gate driver by the gate lines G0 and G1 are enabled, such that all of pixels in the $1^{st}$ pixel row as shown in FIG. 1 are turned on, and at this time, the source driver would respectively write corresponding display data into all of pixels in the $1^{st}$ pixel row as shown in FIG. 1 by the source lines D0~D3. During the period T1, since the real display data have correspondingly written into all of even pixels in the $1^{st}$ pixel row as shown in FIG. 1, all of even pixels in the $1^{st}$ pixel row as shown in FIG. 1 are all in the holding state.

Next, during the period T2, the scan signals S0 and S1 output from the gate driver by the gate lines G0 and G1 are respectively enabled and disabled, such that all of even pixels in the $1^{st}$ pixel row as shown in FIG. 1 are still turned on. Since all of even pixels in the $1^{st}$ pixel row as shown in FIG. 1 have been in the holding state during the period T1, all of pixels in the $1^{st}$ pixel row as shown in FIG. 1 would be influenced by the feed through effect when the scan signal S1 is disabled during the period T2.

Next, during the period T3, the scan signals S0~S2 output from the gate driver by the gate lines G0~G2 are respectively disabled, enabled and enabled, such that all of odd pixels in the $1^{st}$ pixel row and all of pixels in the $2^{nd}$ pixel row as shown in FIG. 1 are turned on, and at this time, the source driver would respectively write corresponding display data into all of odd pixels in the $1^{st}$ pixel row and all of pixels in the $2^{nd}$ pixel row as shown in FIG. 1 by the source lines D0~D4.

Since all of even pixels in the $1^{st}$ pixel row as shown in FIG. 1 have been in the holding state during the period T1, all of even pixels in the $1^{st}$ pixel row as shown in FIG. 1 would be influenced by the feed through effect again when the scan signal S0 is disabled during the period T3. That is, all of even pixels in the $1^{st}$ pixel row as shown in FIG. 1 would be influenced by the feed through effect twice. In addition, during the period T3, since the real display data have correspondingly written into all of odd pixels in the $1^{st}$ and $2^{nd}$ pixel rows as shown in FIG. 1, all of odd pixels in the $1^{st}$ and $2^{nd}$ pixel rows as shown in FIG. 1 are all in the holding state.

Next, during the period T4, the scan signals S1 and S2 output from the gate driver by the gate lines G1 and G2 are respectively enabled and disabled, such that all of odd pixels in the $1^{st}$ and $2^{nd}$ pixel rows as shown in FIG. 1 are still turned on. Since all of odd pixels in the $1^{st}$ and $2^{nd}$ pixel rows as shown in FIG. 1 have been in the holding state during the period T3, all of pixels in the $2^{nd}$ pixel row as shown in FIG. 1 would be influenced by the feed through effect when the scan signal S2 is disabled during the period T4.

Next, during the period T5, the scan signals S1~S3 output from the gate driver by the gate lines G1~G3 are respectively disabled, enabled and enabled, such that all of even pixels in the $2^{nd}$ pixel row and all of pixels in the $3^{rd}$ pixel row as shown in FIG. 1 are turned on, and at this time, the source driver would respectively write corresponding display data into all of even pixels in the $2^{nd}$ pixel row and all of pixels in the $3^{rd}$ pixel row as shown in FIG. 1 by the source lines D0~D3.

Since all of odd pixels in the $1^{st}$ and $2^{nd}$ pixel rows as shown in FIG. 1 have been in the holding state during the period T3, all of odd pixels in the $1^{st}$ pixel row as shown in FIG. 1 would be influenced by the feed through effect when the scan signal S1 is disabled during the period T5. That is, all of odd pixels in the $1^{st}$ pixel row as shown in FIG. 1 would be influenced by the feed through effect once. Moreover, all of odd pixels in the $2^{nd}$ pixel row as shown in FIG. 1 would be influenced by the feed through effect again when the scan signal S1 is disabled during the period T5. That is, all of odd pixels in the $2^{nd}$ pixel row as shown in FIG. 1 would be influenced by the feed through effect twice.

In summary, the number of times of each of red (R), green (G) and blue (B) pixels being influenced by the feed through effect is determined by calculating the number of times of each of red (R), green (G) and blue (B) pixels, which has been in the holding state, being influenced by disablement of corresponding scan signals. Therefore, all of odd pixels in the $1^{st}$ pixel row as shown in FIG. 1 would be influenced by the feed through effect once, and all of even pixels in the $1^{st}$ pixel row as shown in FIG. 1 would be influenced by the feed through effect twice. Herein, for conveniently explaining, in FIG. 1, a numeral is marked in each of red (R), green (G) and blue (B) pixels, and this numeral represents the number of times of each of red (R), green (G) and blue (B) pixels being influenced by the feed through effect.

From the above, the number of times of the same color pixels being influenced by the feed through effect is not the same. For example, the number of times of all of red (R), green (G) or blue (B) pixels in the same pixel row as shown in FIG. 1 is either once or twice. In addition, the number of times of all of red (R), green (G) or blue (B) pixels in the same pixel column as shown in FIG. 1 is also either once or twice. Accordingly, since the number of times of the same color pixels being influenced by the feed through effect is not the same, the brightness of the image frames displayed on the LCD panel is not uniform.

SUMMARY OF THE INVENTION

The present invention is directed to a liquid crystal display (LCD). The structure of the pixel array of the display panel in the LCD is one third source driving (OTSD) structure, so as to further reduce the number of driving channels of the source driver, and make that the number of times of the same color pixels or all of the pixels in the display panel being influenced by the feed through effect is substantially the same.

The present invention provides an LCD including a display panel and a source driver. The display panel has a plurality of pixels arranged in an array. The source driver is coupled to the display panel and has a plurality of source lines, wherein each of the source lines of the source driver is responsible for performing pixel-writing to six corresponding pixel columns.

In an embodiment of the present invention, the LCD further includes a gate driver coupled to the display panel and having a plurality of gate lines, wherein each of the gate lines of the gate driver is responsible for performing pixel-turning on or off to a corresponding pixel row. Under this condition, the $i^{th}$ gate line of the gate driver is coupled to all of pixels in the $i^{th}$ pixel row of the display panel, where i is a positive integer greater than or equal to 0. In addition, the $j^{th}$ source line of the source driver is coupled to odd pixels of all of pixels in the $(3j+1)^{th}$, $(3j+3)^{th}$ and $(3j+5)^{th}$ pixel columns of the display panel, and even pixels of all of pixels in the $(3j+2)^{th}$, $(3j+4)^{th}$ and $(3j+6)^{th}$ pixel columns of the display panel, where j is a positive integer greater than or equal to 0.

In an another embodiment of the present invention, the LCD further includes a gate driver coupled to the display panel and having a plurality of gate lines, wherein each of the gate lines of the gate driver is responsible for performing pixel-turning on or off to three corresponding pixel rows. Under this condition, the $i^{th}$ gate line of the gate driver is coupled to the $(3j+1)^{th}$ pixel of all of pixels in the $i^{th}$ pixel row of the display panel, the $(3j+2)^{th}$ pixel of all of pixels in the $(i+1)^{th}$ pixel row of the display panel, and the $(3j+3)^{th}$ pixel of all of pixels in the $(i+2)^{th}$ pixel row of the display panel, where i and j are a positive integer greater than or equal to 0. In addition, the $j^{th}$ source line of the source driver is coupled to odd pixels of all of pixels in the $(3j+1)^{th}$, $(3j+2)^{th}$ and $(3j+3)^{th}$ pixel columns of the display panel, and even pixels of all of pixels in the $(3j+4)^{th}$, $(3j+5)^{th}$ and $(3j+6)^{th}$ pixel columns of the display panel.

In a further embodiment of the present invention, a frame period of the LCD has a plurality of periods, and the $i^{th}$, $(i+1)^{th}$ and $(i+2)^{th}$ gate lines of the gate driver simultaneously output enabled scan signal during the $(3i+1)^{th}$ period. In addition, the $i^{th}$ and $(i+1)^{th}$ gate lines of the gate driver simultaneously output enabled scan signal during the $(3i+2)^{th}$ period. Furthermore, the $i^{th}$ gate line of the gate driver outputs enabled scan signal during the $(3i+3)^{th}$ period.

In a yet embodiment of the present invention, the enabled scan signal output by the $i^{th}$ gate line of the gate driver would be briefly disabled twice during the $(3i+1)^{th}$ through $(3i+3)^{th}$ periods. In addition, the enabled scan signal output by the $(i+1)^{th}$ gate line of the gate driver would be briefly disabled once during the $(3i+1)^{th}$ through $(3i+2)^{th}$ periods.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
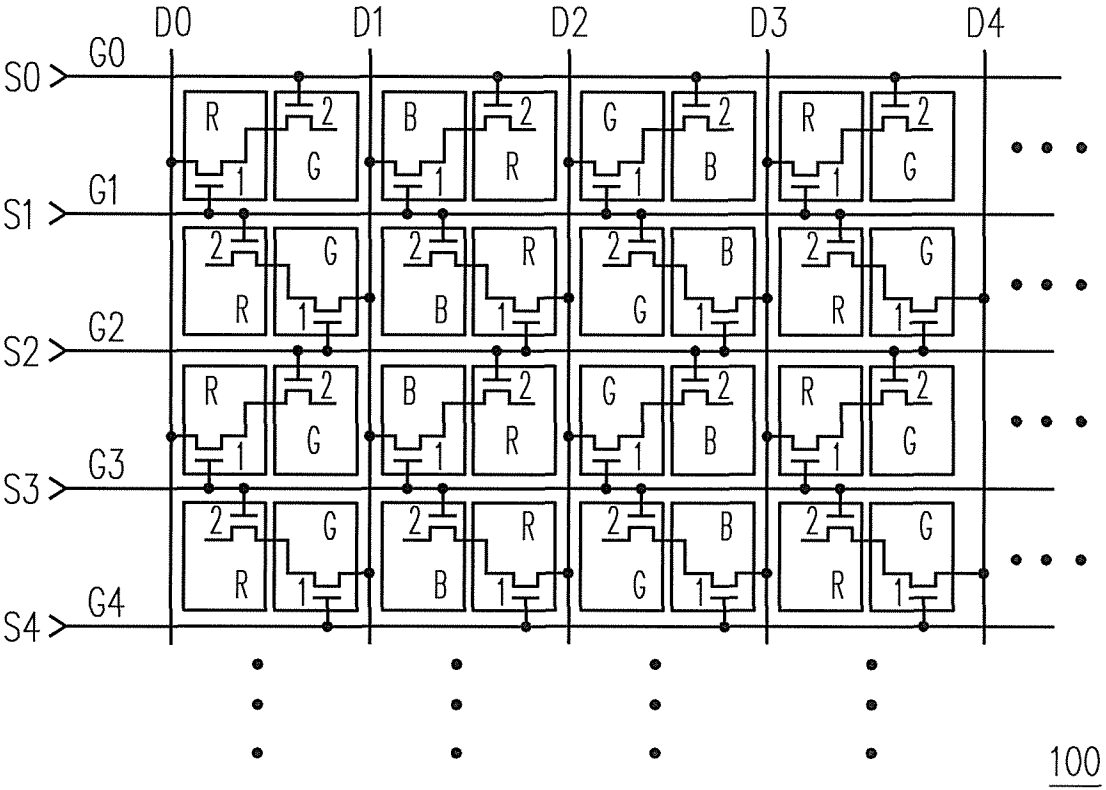
FIG. 1 (PRIOR ART)
FIG. 1 is a diagram of a part of the conventional LCD panel 100 adopting HSD structure.
Figure 2:
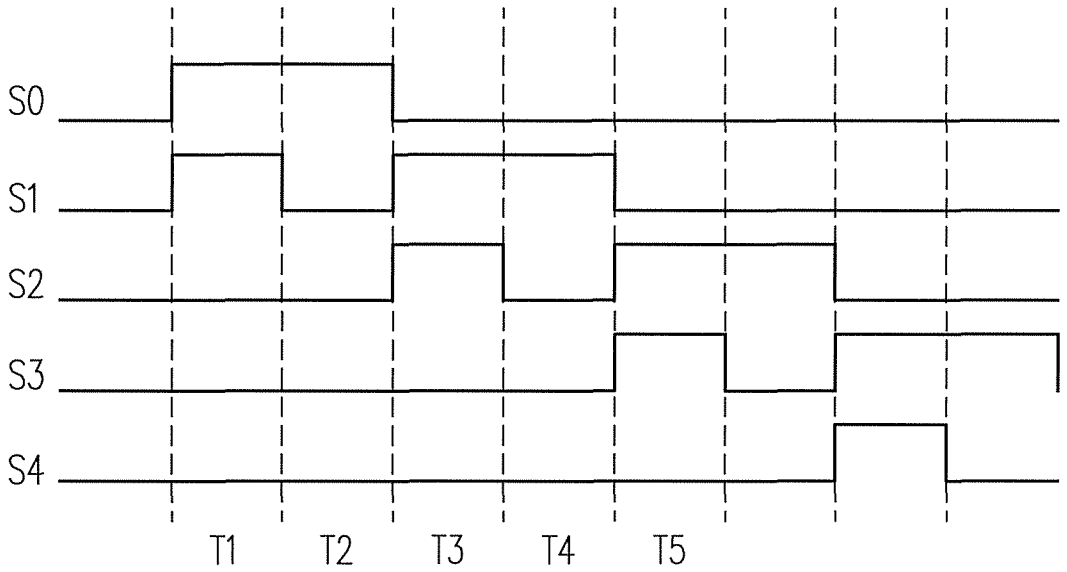
FIG. 2 (PRIOR ART)
FIG. 2 is a diagram of a part of driving waveform for the LCD panel 100 as shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

First Embodiment

Figure 3:
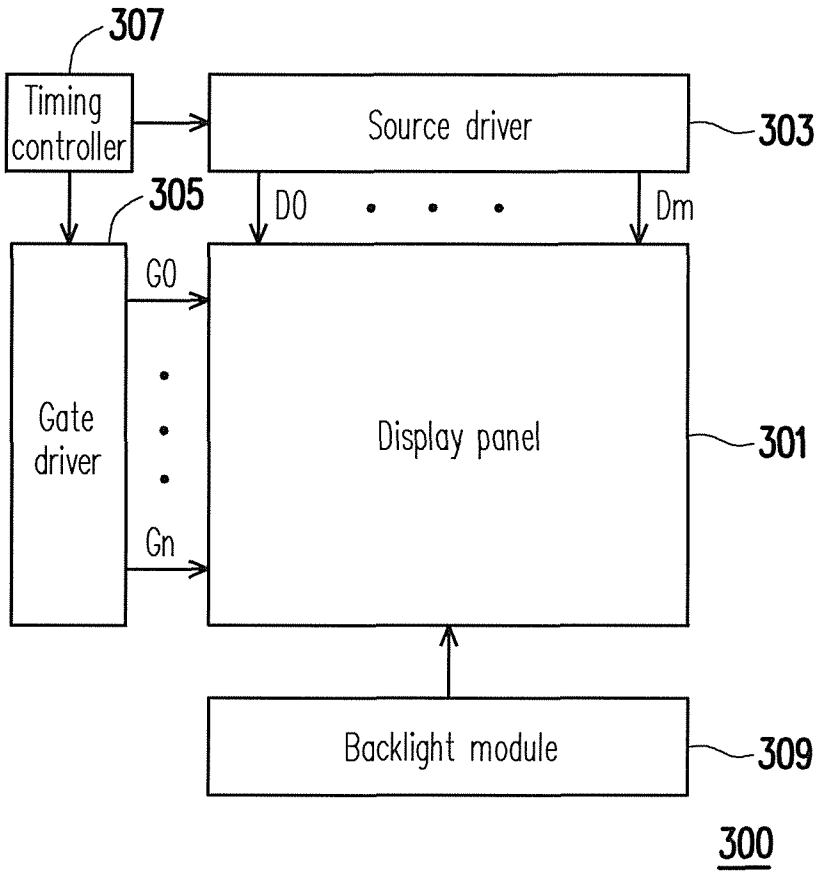
FIG. 3 is a system diagram of an LCD 300 according to a first embodiment of the present invention.
Figure 4:
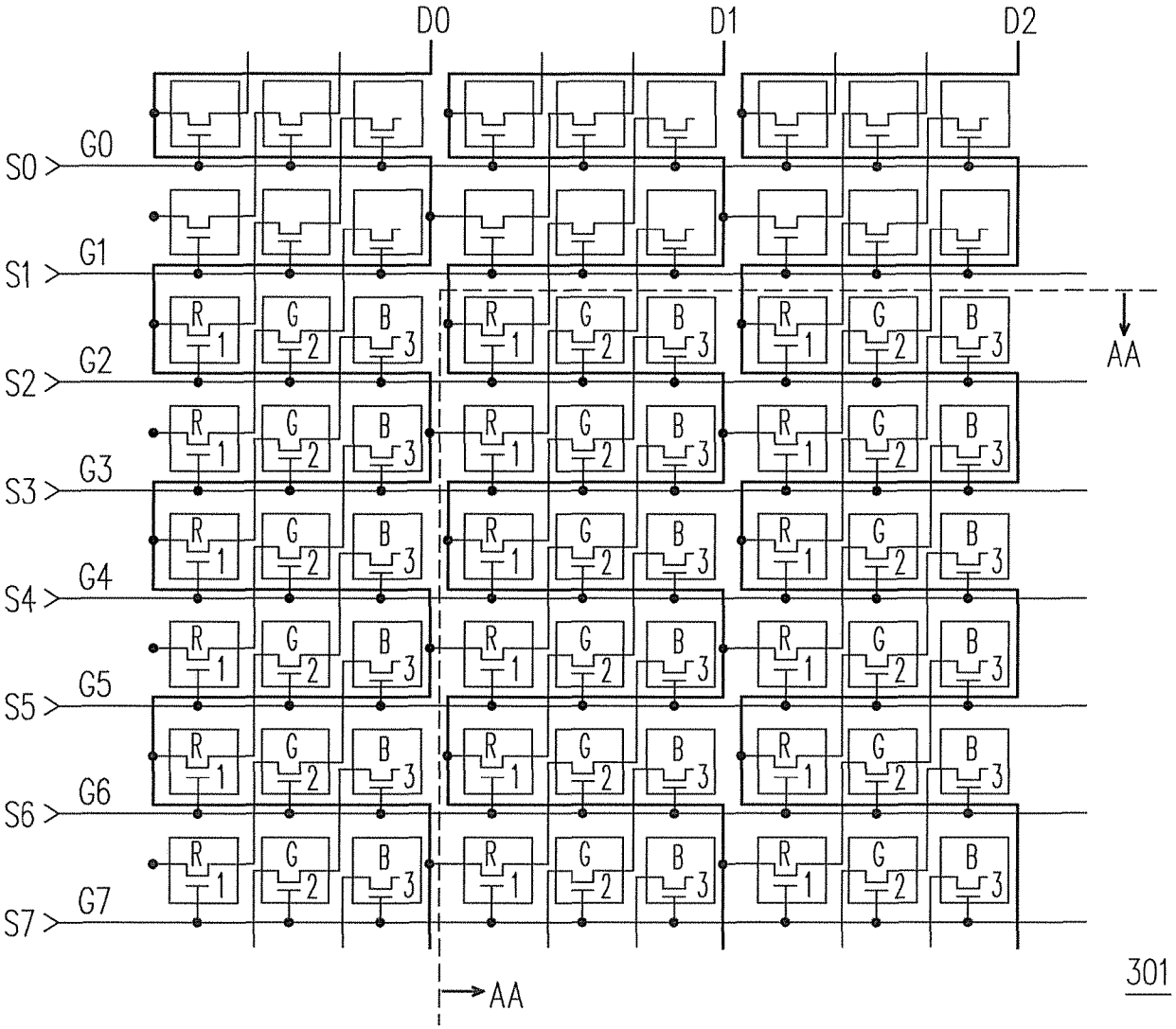
FIG. 4 is a diagram of a part of a display panel 301 according to a first embodiment of the present invention.

FIG. 3 is a system diagram of an LCD 300 according to the first embodiment of the present invention. FIG. 4 is a diagram of a part of a display panel 301 according to the first embodiment of the present invention. Referring to FIGS. 3 and 4, the LCD 300 includes a display panel 301, a source driver 303, a gate driver 305, a timing controller 307 and a backlight module 309. The display panel 301 has a plurality of red (R), green (G) and blue (B) pixels arranged in an array. The display panel 301 as shown in FIG. 4 has 8 pixel rows and 9 pixels columns, but not limited thereto. Each of the pixels in the $1^{st}$ and $2^{nd}$ pixel rows and the $1^{st}$ through $3^{rd}$ pixel columns is a dummy pixel, and is not in the display area AA of the display panel 301.

The source driver 303 is coupled to the display panel 301 and has a plurality of source lines D0~Dm which can be interpreted as the driving channels of the source driver 303. Each of the source lines D0~Dm of the source driver 303 is responsible for performing pixel-writing to six corresponding pixel columns. The gate driver 305 is coupled to the display panel 301 and has a plurality of gate lines G0~Gn. Each of the gate lines G0~Gn of the gate driver 305 is responsible for performing pixel-turning on or off to a corresponding pixel row. The timing controller 307 is coupled to the source driver 303 and the gate driver 305, and used for controlling the operations of the source driver 303 and the gate driver 305. The backlight module 309 is used for providing the backlight source required by the display panel 301.

In the first embodiment, the $i^{th}$ gate line of the gate driver 305 is coupled to all of pixels in the $i^{th}$ pixel row of the display panel 301, where i is a positive integer greater than or equal to 0. For example, the $0^{th}$ gate line G0 of the gate driver 305 is coupled to all of pixels in the $0^{th}$ pixel row of the display panel 301; and the $1^{st}$ gate line G1 of the gate driver 305 is coupled to all of pixels in the $1^{st}$ pixel row of the display panel 301. And so on.

In addition, the $j^{th}$ source line of the source driver 303 is coupled to odd pixels of all of pixels in the $(3j+1)^{th}$, $(3j+3)^{th}$ and $(3+5)^{th}$ pixel columns of the display panel 301, and even pixels of all of pixels in the $(3j+2)^{th}$, $(3j+4)^{th}$ and $(3j+6)^{th}$ pixel columns of the display panel 301, where j is a positive integer greater than or equal to 0. For example, the $0^{th}$ source line D0 of the source driver 303 is coupled to odd pixels of all of pixels in the $1^{st}$, $3^{rd}$ and $5^{th}$ pixel columns of the display panel 301, and even pixels of all of pixels in the $2^{nd}$, $4^{th}$ and $6^{th}$ pixel columns of the display panel 301; and the $1^{st}$ source line D1 of the source driver 303 is coupled to odd pixels of all of pixels in the $4^{th}$, $6^{th}$ and $8^{th}$ pixel columns of the display panel 301, and even pixels of all of pixels in the $5^{th}$, $7^{th}$ and $9^{th}$ pixel columns of the display panel 301. And so on.

Figure 5:
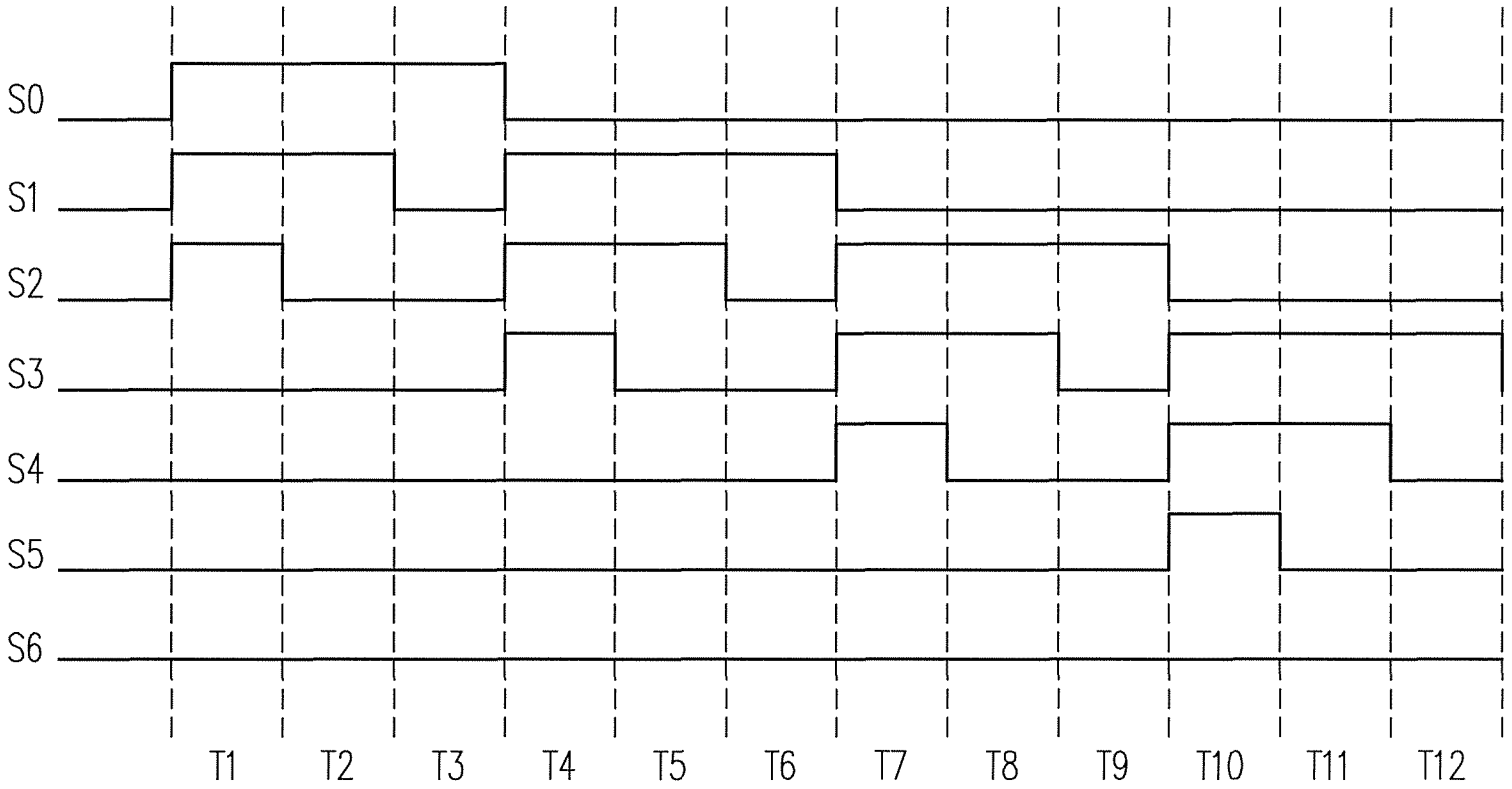
FIG. 5 is a diagram of a part of driving waveform for the display panel 301 according to an embodiment of the present invention.

FIG. 5 is a diagram of a part of driving waveform for the display panel 301 according to an embodiment of the present invention. Referring to FIGS. 3 to 5, it can be clearly seen that, in FIG. 5, a frame period of the LCD 100 has a plurality of periods T1~T12, but not limited thereto. In the present embodiment, the $i^{th}$, $(i+1)^{th}$ and $(i+2)^{th}$ gate lines of the gate driver 305 simultaneously output enabled scan signal during the $(3i+1)^{th}$ period. In addition, the $i^{th}$ and $(i+1)^{th}$ gate lines of the gate driver 305 simultaneously output enabled scan signal during the $(3i+2)^{th}$ period. Furthermore, the $i^{th}$ gate line of the gate driver 305 outputs enabled scan signal during the $(3i+3)^{th}$ period.

For example, the $0^{th}$, $1^{st}$ and $2^{nd}$ gate lines G0~G2 of the gate driver 305 simultaneously output enabled scan signal during the $1^{st}$ period T1 (i.e. i=0). In addition, the $0^{th}$ and $1^{st}$ gate lines G0 and G1 of the gate driver 305 simultaneously output enabled scan signal during the $2^{nd}$ period T2. Furthermore, the $0^{th}$ gate line G0 of the gate driver 305 outputs enabled scan signal during the $3^{rd}$ period T3. And so on.

Below, the display data being written into the $2^{nd}$ pixel row of the display panel 301 by the source driver 303 would firstly explain, namely, the pixels located in the display area AA.

The $2^{nd}$, $3^{rd}$ and $4^{th}$ gate lines G2~G4 of the gate driver 305 simultaneously output enabled scan signal S2, S3 and S4 during the $7^{th}$ period T7, so as to turn on all of pixels in the $2^{nd}$, $3^{rd}$ and $4^{th}$ pixel rows in the display panel 301, and at this time, the source driver 303 would respectively write corresponding display data into all of pixels in the $2^{nd}$, $3^{rd}$ and $4^{th}$ pixel rows of the display panel 301 by the source lines D0~D2. During the $7^{th}$ period T7, since the real display data have correspondingly written into all of blue (B) pixels in the $2^{nd}$ pixel row of the display panel 301, all of blue (B) pixels in the $2^{nd}$ pixel row of the display panel 301 are all in the holding state.

Next, the $2^{nd}$ and $3^{rd}$ gate lines G2 and G3 of the gate driver 305 simultaneously output enabled scan signal S2 and S3 during the $8^{th}$ period T8, so as to turn on all of pixels in the $2^{nd}$ and $3^{rd}$ pixel rows of the display panel 301, and at this time, the source driver 303 would respectively write corresponding display data into all of red (R) and green (G) pixels in the $2^{nd}$ pixel row of the display panel 301, and all of red (R) pixels in the $3^{rd}$ pixel row of the display panel 301 by the source lines D0~D2. During the $8^{th}$ period T8, since the real display data have correspondingly written into all of green (G) pixels in the $2^{nd}$ pixel row of the display panel 301, all of green (G) pixels in the $2^{nd}$ pixel row of the display panel 301 are all in the holding state. In addition, since all of blue (B) pixels in the $2^{nd}$ pixel row of the display panel 301 have been in the holding state during the period T7, all of blue (B) pixels in the $2^{nd}$ pixel row of the display panel 301 would be influenced by the feed through effect when the scan signal S4 is disabled during the period T8.

Next, the $2^{nd}$ gate line G2 of the gate driver 305 outputs enabled scan signal S2 during the $9^{th}$ period T9, so as to turn on all of pixels in the $2^{nd}$ pixel row of the display panel 301, and at this time, the source driver 303 would respectively write corresponding display data into all of red (R) pixels in the $2^{nd}$ pixel row of the display panel 301 by the source lines D0~D2. During the period T9, since the real display data have correspondingly written into all of red (R) pixels in the $2^{nd}$ pixel row of the display panel 301, all of red (R) pixels in the $2^{nd}$ pixel row of the display panel 301 are all in the holding state. In addition, since all of blue (B) and green (G) pixels in the $2^{nd}$ pixel row of the display panel 301 have been in the holding state during the periods T7 and T8 respectively, all of blue (B) pixels in the $2^{nd}$ pixel row of the display panel 301 would be influenced by the feed through effect again when the scan signal S3 is disabled during the period T9; and all of green (G) pixels in the $2^{nd}$ pixel row of the display panel 301 also would be influenced by the feed through effect when the scan signal S3 is disabled during the period T9.

Then, during the $10^{th}$ period T10, since the $2^{nd}$ gate line G2 of the gate driver 305 would output disabled scan signal S2, all of blue (B) pixels in the $2^{nd}$ pixel row of the display panel 301 would be influenced by the feed through effect further again when the scan signal S2 is disabled during the period T10; all of green (G) pixels in the $2^{nd}$ pixel row of the display panel 301 would be influenced by the feed through effect again when the scan signal S2 is disabled during the period T10; and all of red (R) pixels in the $2^{nd}$ pixel row of the display panel 301 would be influenced by the feed through effect when the scan signal S2 is disabled during the period T10.

In accordance with the contents of explaining for the display data being written into the $2^{nd}$ pixel row of the display panel 301 by the source driver 303, one person having ordinary skilled in the art should analogize the manner of the display data being written into other pixel rows of the display panel 301 by the source driver 303, so the details would not describe herein.

In summary, the number of times of each of red (R), green (G) and blue (B) pixels in the display panel 301 being influenced by the feed through effect is determined by calculating the number of times of each of red (R), green (G) and blue (B) pixels, which has been in the holding state, being influenced by disablement of corresponding scan signals. Therefore, each of red (R) pixels in each of pixel row or pixel column of the display panel 301 would be influenced by the feed through effect once; each of green (G) pixels in each of pixel row or pixel column of the display panel 301 would be influenced by the feed through effect twice; and each of blue (B) pixels in each of pixel row or pixel column of the display panel 301 would be influenced by the feed through effect for three-times. Herein, for conveniently explaining, in FIG. 4, a numeral is marked in each of red (R), green (G) and blue (B) pixels, and this numeral represents the number of times of each of red (R), green (G) and blue (B) pixels in the display panel 301 being influenced by the feed through effect.

From the above, the number of times of the same color pixels being influenced by the feed through effect is the same. For example, the number of times of all of red (R) pixels in the same pixel row and pixel column in the display panel 301 is one-times; the number of times of all of green (G) pixels in the same pixel row and pixel column in the display panel 301 is two-times; and the number of times of all of blue (B) pixels in the same pixel row and pixel column in the display panel 301 is three-times. Accordingly, since the number of times of the same color pixels being influenced by the feed through effect is the same, the brightness of the image frames displayed on the display panel 301 is uniform, and thus improving the drawbacks mentioned in the "Description of the Related Art".

Figure 6:
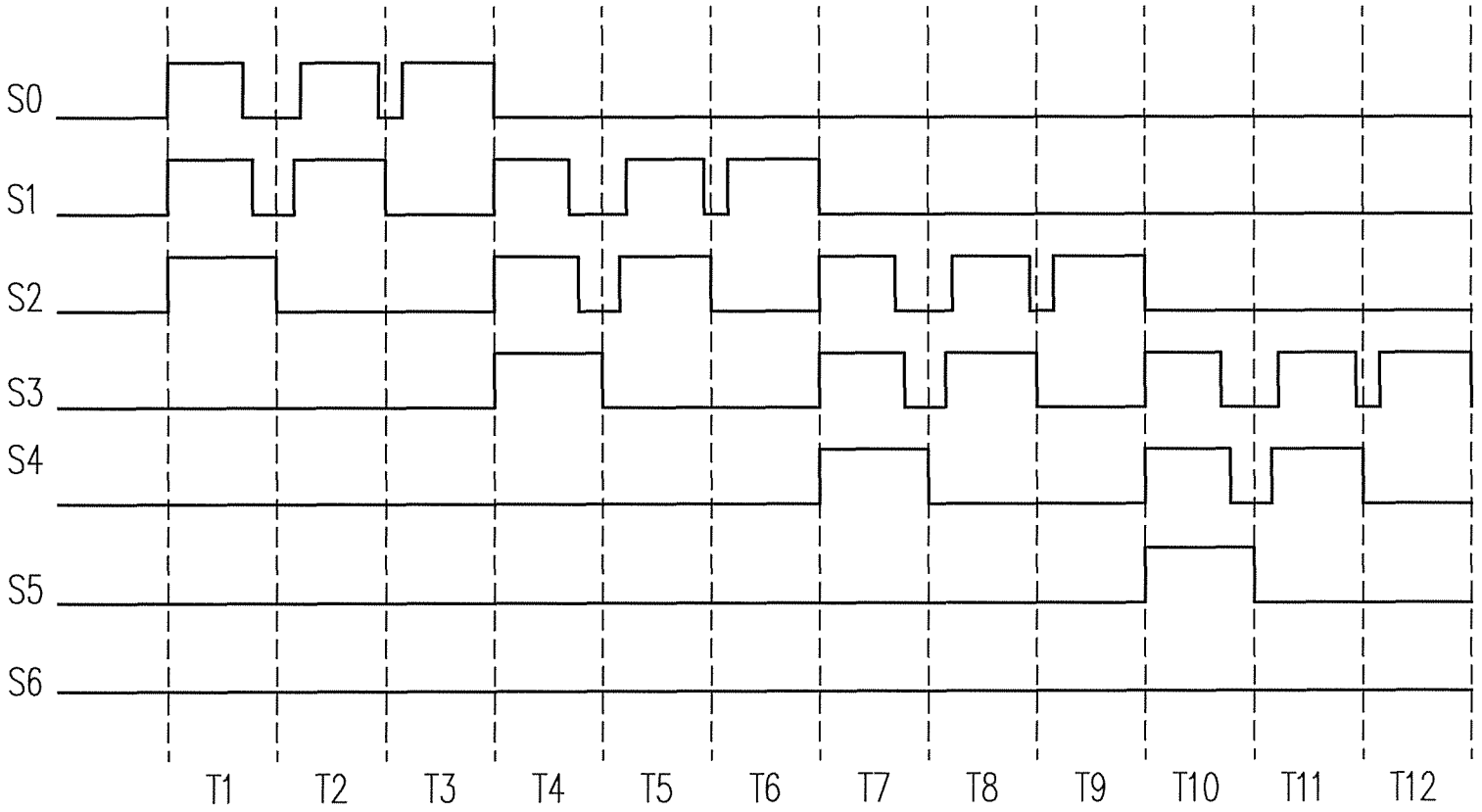
FIG. 6 is a diagram of a part of driving waveform for the display panel 301 according to another embodiment of the present invention.

Besides, FIG. 6 is a diagram of a part of driving waveform for the display panel 301 according to another embodiment of the present invention. Referring to FIGS. 3 to 6, comparing FIG. 5 with FIG. 6, the difference between FIG. 5 and FIG. 6 is that, in FIG. 6, the enabled scan signal output by the $i^{th}$ gate line of the gate driver 305 would be briefly disabled twice during the $(3i+1)^{th}$ through $(3i+3)^{th}$ periods; and the enabled scan signal output by the $(i+1)^{th}$ gate line of the gate driver 305 would be briefly disabled once during the $(3i+1)^{th}$ through $(3i+2)^{th}$ periods.

For example, the enabled scan signal S1 output, during the $1^{st}$ and $2^{nd}$ periods T1 and T2, from the $1^{st}$ gate line G1 of the gate driver 305 would be briefly disabled before the enabled scan signal S2 output, during the $1^{st}$ period T1, from the $2^{nd}$ gate line G2 of the gate driver 305 occurs disablement. In addition, the enabled scan signal S0 output, during the $1^{st}$ and $2^{nd}$ periods T1 and T2, from the $0^{th}$ gate line G0 of the gate driver 305 further would be briefly disabled before the enabled scan signal S1 output, during the $1^{st}$ period T1, from the $1^{st}$ gate line G1 of the gate driver 305 occurs disablement. Furthermore, the enabled scan signal S0 output, during the $2^{nd}$ and $3^{rd}$ periods T2 and T3, from the $0^{th}$ gate line G0 of the gate driver 305 would be briefly disabled before the enabled scan signal S1 output, during the $2^{nd}$ period T2, from the $1^{st}$ gate line G1 of the gate driver 305 occurs disablement. And so on.

Accordingly, if the display panel 301 is driven by using the driving waveform as shown in FIG. 6, the number of times of all of the pixels in the display panel 301 being influenced by the feed through effect is substantially the same, so as to avoid that the image frames displayed on the display panel 301 produce color shift.

Second Embodiment

Figure 7:
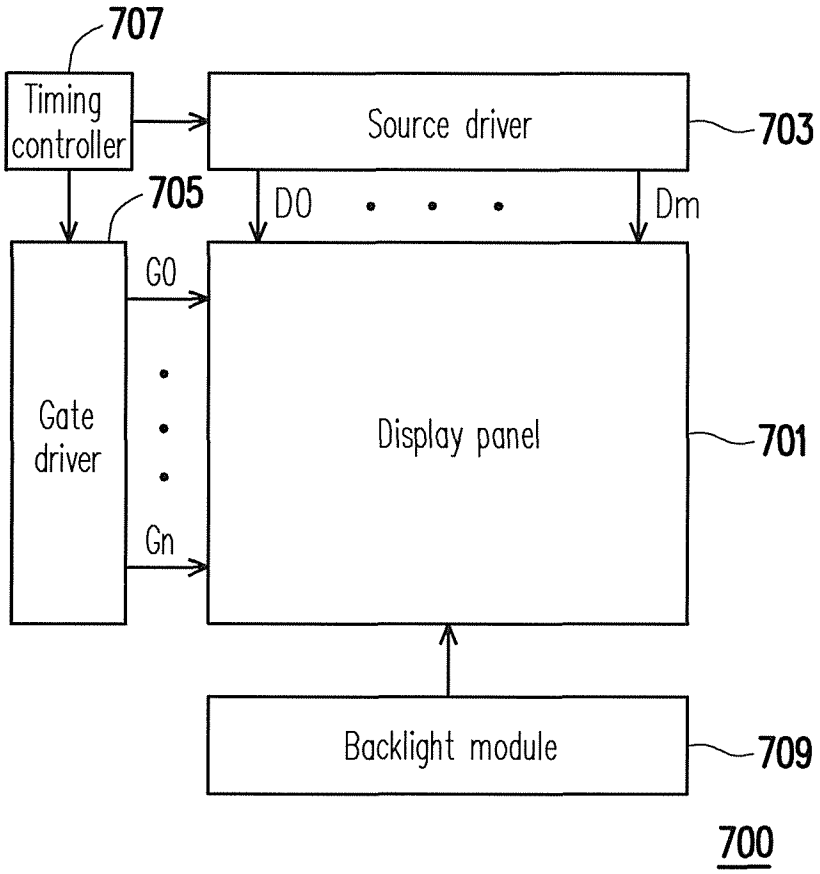
FIG. 7 is a system diagram of an LCD 700 according to a second embodiment of the present invention.
Figure 8:
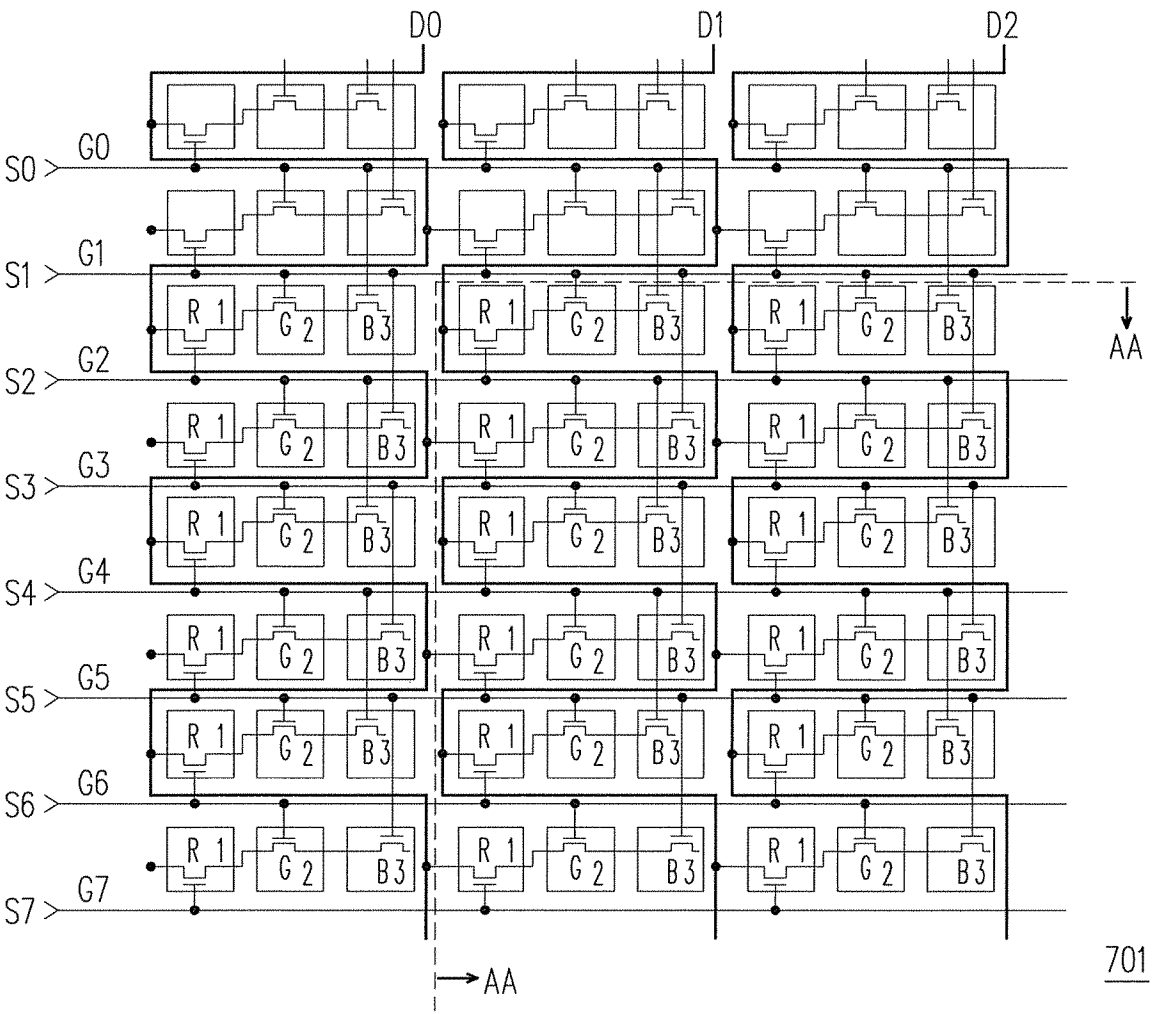
FIG. 8 is a diagram of a part of a display panel 701 according to a second embodiment of the present invention.

FIG. 7 is a system diagram of an LCD 700 according to a second embodiment of the present invention. FIG. 8 is a diagram of a part of a display panel 701 according to a second embodiment of the present invention. Referring to FIGS. 7 and 8, the LCD 700 includes a display panel 701, a source driver 703, a gate driver 705, a timing controller 707 and a backlight module 709. The display panel 701 has a plurality of red (R), green (G) and blue (B) pixels arranged in an array. The display panel 701 as shown in FIG. 8 has 8 pixel rows and 9 pixels columns, but not limited thereto. Each of the pixels in the $1^{st}$ and $2^{nd}$ pixel rows and the $1^{st}$ through $3^{rd}$ pixel columns is a dummy pixel, and is not in the display area AA of the display panel 701.

The source driver 703 is coupled to the display panel 701 and has a plurality of source lines D0~Dm which can be interpreted as the driving channels of the source driver 703. Each of the source lines D0~Dm of the source driver 703 is responsible for performing pixel-writing to six corresponding pixel columns. The gate driver 705 is coupled to the display panel 701 and has a plurality of gate lines G0~Gn. Each of the gate lines G0~Gn of the gate driver 705 is responsible for performing pixel-turning on or off to three corresponding pixel rows. The timing controller 707 is coupled to the source driver 703 and the gate driver 705, and used for controlling the operations of the source driver 703 and the gate driver 705. The backlight module 709 is used for providing the backlight source required by the display panel 701.

In the second embodiment, the $i^{th}$ gate line of the gate driver 705 is coupled to the $(3j+1)^{th}$ pixel of all of pixels in the $i^{th}$ pixel row of the display panel 701, the $(3j+2)^{th}$ pixel of all of pixels in the $(i+1)^{th}$ pixel row of the display panel 701, and the $(3j+3)^{th}$ pixel of all of pixels in the $(i+2)^{th}$ pixel row of the display panel 701, where i and j are a positive integer greater than or equal to 0. For example, the $0^{th}$ gate line G0 of the gate driver 705 is coupled to the $1^{st}$, $4^{th}$ and $7^{th}$ pixels of all of pixels in the $0^{th}$ pixel row of the display panel 701, the $2^{nd}$, $5^{th}$ and $8^{th}$ pixels of all of pixels in the $1^{st}$ pixel row of the display panel 701, and the $3^{rd}$, $6^{th}$ and $9^{th}$ pixels of all of pixels in the $2^{nd}$ pixel row of the display panel 701. And so on.

In addition, the $j^{th}$ source line of the source driver 703 is coupled to odd pixels of all of pixels in the $(3j+1)^{th}$, $(3j+2)^{th}$ and $(3j+3)^{th}$ pixel columns of the display panel 701, and even pixels of all of pixels in the $(3j+4)^{th}$, $(3j+5)^{th}$ and $(3j+6)^{th}$ pixel columns of the display panel 701. For example, the $0^{th}$ source line D0 of the source driver 703 is coupled to odd pixels of all of pixels in the $1^{st}$ through $3^{rd}$ pixel columns of the display panel 701, and even pixels of all of pixels in the $4^{th}$ through $6^{th}$ pixel columns of the display panel 701. Moreover, the $1^{st}$ source line D1 of the source driver 703 is coupled to odd pixels of all of pixels in the $4^{th}$ through $6^{th}$ pixel columns of the display panel 701, and even pixels of all of pixels in the $7^{th}$ through $9^{th}$ pixel columns of the display panel 701. And so on.

Herein, the driving waveforms as shown in FIGS. 5 and 6 of the first embodiment also can be used for driving the display panel 701. In the second embodiment, when the display panel 701 is driven by using the driving waveform as shown in FIG. 5, each of blue (B) pixels in each of pixel row or pixel column of the display panel 701 would be influenced by the feed through effect for three-times; each of green (G) pixels in each of pixel row or pixel column of the display panel 701 would be influenced by the feed through effect twice; and each of red (R) pixels in each of pixel row or pixel column of the display panel 701 would be influenced by the feed through effect once. Herein, for conveniently explaining, in FIG. 8, a numeral is marked in each of red (R), green (G) and blue (B) pixels, and this numeral represents the number of times of each of red (R), green (G) and blue (B) pixels in the display panel 701 being influenced by the feed through effect.

From the above, the number of times of the same color pixels being influenced by the feed through effect is the same. Accordingly, since the number of times of the same color pixels being influenced by the feed through effect is the same, the brightness of the image frames displayed on the display panel 701 is uniform, and thus improving the drawbacks mentioned in the "Description of the Related Art". In addition, when the display panel 701 is driven by using the driving waveform as shown in FIG. 6, since the number of times of all of the pixels in the display panel 701 being influenced by the feed through effect is substantially the same, so as to avoid that the image frames displayed on the display panel 701 produce color shift.

In total summary, since the structure of the pixel array of the display panel in the LCD submitted by the present invention is one third source driving (OTSD) structure, so as to further reduce the number of driving channels of the source driver compared to the HSD structure. To be specific, the number of driving channels of the source driver can be reduced to two thirds. Besides, even though the structure of the pixel array of the display panel in the LCD submitted by the present invention is OTSD structure, but the number of times of the same color pixels or all of the pixels in the display panel being influenced by the feed through effect is substantially the same by using two different driving methods (i.e. the driving waveforms as shown in FIGS. 5 and 6) to drive the display panel. Therefore, the present invention can achieve the purpose of improving the drawbacks mentioned in the "Description of the Related Art", and further avoiding that the image frames displayed on the display panel produce color shift.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A liquid crystal display (LCD), comprising:

a display panel having a plurality of pixels arranged in an array;

a source driver coupled to the display panel and having a plurality of source lines, wherein each of the source lines is responsible for performing pixel-writing to six corresponding pixel columns; and a gate driver coupled to the display panel and having a plurality of gate lines, wherein each of the gate lines is responsible for performing pixel-turning on or off to three corresponding pixel rows, wherein a frame period of the LCD has a plurality of periods, wherein, in the $(3i+1)^{th}$ period, the $(i+1)^{th}$ and $(i+2)^{th}$ gate lines output enabled scan signals, where i is an integer greater than or equal to 0, and wherein, in the $(3i+2)^{th}$ period, the $i^{th}$ and $(i+1)^{th}$ gate lines output enabled scan signals and the $(i+2)^{th}$ gate line outputs disabled scan signal.

2. The LCD according to claim 1, wherein the $i^{th}$ gate line is coupled to the $(3j+1)^{th}$ pixel of all of pixels in the $i^{th}$ pixel row, the $(3j+2)^{th}$ pixel of all of pixels in the $(i+1)^{th}$ pixel row, and the $(3j+3)^{th}$ pixel of all of pixels in the $(i+2)^{th}$ pixel row, where j is an integer greater than or equal to 0.

3. The LCD according to claim 2, wherein the $j^{th}$ source line is coupled to pixels in $(k-1)^{th}$ pixel row in the $(3j+1)^{th}$, $(3j+2)^{th}$ and $(3j+3)^{th}$ pixel columns, and pixels in $k^{th}$ pixel row in the $(3j+4)^{th}$, $(3j+5)^{th}$ and $(3j+6)^{th}$ pixel columns, where k is a positive odd integer.

4. The LCD according to claim 1, wherein the $i^{th}$ gate line outputs enabled scan signal during the $(3i+3)^{th}$ period.

5. The LCD according to claim 4, wherein the enabled scan signal output by the $i^{th}$ gate line would be disabled twice during the $(3i+1)^{th}$ through $(3i+3)^{th}$ periods.

6. The LCD according to claim 5, wherein the enabled scan signal output by the $(i+1)^{th}$ gate line would be briefly disabled once during the $(3i+1)^{th}$ through $(3i+2)^{th}$ periods.

7. A liquid crystal display (LCD), comprising:

a display panel having a plurality of pixels arranged in an array;

a source driver coupled to the display panel and having a plurality of source lines, wherein each of the source lines is responsible for performing pixel-writing to six corresponding pixel columns; and a gate driver coupled to the display panel and having a plurality of gate lines, wherein each of the gate lines is responsible for performing pixel-turning on or off to three corresponding pixel rows, wherein a number of times of all of the pixels in the $(3j+1)^{th}$ and $(3j+4)^{th}$ pixel columns being influenced by a feed through effect is equal to a first predetermined value, and all of the pixels in the $(3j+1)^{th}$ and $(3j+4)^{th}$ pixel columns are corresponding to a first color, where j is an integer greater than or equal to 0, wherein a number of times of all of the pixels in the $(3j+2)^{th}$ and $(3j+5)^{th}$ pixel columns being influenced by the feed through effect is the same and equal to a second predetermined value, and all of the pixels in the $(3j+2)^{th}$ and $(3j+5)^{th}$ pixel columns are corresponding to a second color, wherein a number of times of all of the pixels in the $(3j+3)^{th}$ and $(3j+6)^{th}$ pixel columns being influenced by the feed through effect is the same and equal to a third predetermined value, and all of the pixels in the $(3j+3)^{th}$ and $(3j+6)^{th}$ pixel columns are corresponding to a third color, wherein a frame period of the LCD has a plurality of periods, wherein, in the $(3i+1)^{th}$ period, the $i^{th}$, $(i+1)^{th}$ and $(i+2)^{th}$ gate lines output enabled scan signals, where i is an integer greater than or equal to 0, and wherein, in the $(3i+2)^{th}$ period, the $i^{th}$ and $(i+1)^{th}$ gate lines output enabled scan signals and the $(i+2)^{th}$ gate line outputs disabled scan signal.

8. The LCD according to claim 7, wherein the $i^{th}$ gate line is coupled to the $(3j+1)^{th}$ pixel of all of pixels in the $i^{th}$ pixel row, the $(3j+2)^{th}$ pixel of all of pixels in the $(i+1)^{th}$ pixel row, and the $(3j+3)^{th}$ pixel of all of pixels in the $(i+2)^{th}$ pixel row.

9. The LCD according to claim 8, wherein the $j^{th}$ source line is coupled to pixels in $(k-1)^{th}$ pixel row in the $(3i+1)^{th}$, $(3j+2)^{th}$ and $(3j+3)^{th}$ pixel columns, and even pixels of all of pixels in $k^{th}$ pixel row in the $(3j+4)^{th}$, $(3j+5)^{th}$ and $(3j+6)^{th}$ pixel columns, where k is an odd number.

10. The LCD according to claim 7, wherein the $i^{th}$ gate line outputs enabled scan signal during the $(3i+3)^{th}$ period.

11. The LCD according to claim 10, wherein the enabled scan signal output by the $i^{th}$ gate line would be disabled twice during the $(3i+1)^{th}$ through $(3i+3)^{th}$ periods.

12. The LCD according to claim 11, wherein the enabled scan signal output by the $(i+1)^{th}$ gate line would be disabled once during the $(3i+1)^{th}$ through $(3i+2)^{th}$ periods.

* * * * *